United States Patent [19]

Busch, Jr. et al.

[11] 4,381,792

[45] May 3, 1983

[54] COMPOSITIONS, ARTICLES AND METHODS FOR POLISHING SURFACES

[75] Inventors: Francis W. Busch, Jr., Southbury; Thomas J. Pallone, Monroe; Gene R. Berube, Cheshire, all of Conn.; Ambrish H. Vyas, Greenville, N.C.; Joseph R. Faryniarz, Ansonia, Conn.; John A. Russo, Westport, Conn.

[73] Assignee: Chesebrough-Pond's Inc., Greenwich, Conn.

[21] Appl. No.: 378,206

[22] Filed: May 14, 1982

Related U.S. Application Data

[62] Division of Ser. No. 142,831, Apr. 22, 1980, Pat. No. 4,343,910.

[51] Int. Cl.[3] ..... A45D 29/04

[52] U.S. Cl. ..... 132/75.6; 132/76.4; 132/89; 132/90; 132/93; 433/166; 433/216

[58] Field of Search ..... 132/75.6, 76.4, 89, 132/90, 93; 433/166, 216

[56] References Cited

U.S. PATENT DOCUMENTS

| | | | |
|---|---|---|---|
| 2,609,347 | 9/1952 | Wilson | 521/87 |
| 3,377,411 | 4/1968 | Charvat | 264/45.3 |
| 3,912,667 | 10/1975 | Spitzer et al. | 521/65 |
| 3,918,220 | 11/1975 | Jury et al. | 51/328 |
| 4,034,769 | 7/1977 | Nishimura | 51/59 R |

*Primary Examiner*—Maurice J. Welsh

*Attorney, Agent, or Firm*—Morgan, Finnegan, Pine, Foley & Lee

[57] ABSTRACT

Various surfaces are polished by buffing with compositions comprising a foamed polymeric material and a finely divided abrasive material. The abrasive material has a particle size number and a valley abrasion number the product of which falls within a predetermined range sufficient to provide good polishing upon buffing. Such compositions can be fashioned into articles of manufacture which are capable of buffing various surfaces.

18 Claims, 16 Drawing Figures

COMPOSITIONS, ARTICLES AND METHODS FOR POLISHING SURFACES

CROSS-REFERENCE TO RELATED APPLICATIONS

This application is a divisional application of pending application Ser. No. 142,831, filed Apr. 22, 1980, now U.S. Pat. No. 4,343,910, issued Aug. 10, 1982.

FIELD OF THE INVENTION

This invention concerns improved polishing compositions, articles and methods of manufacture and of use. The compositions are useable on a wide variety of surfaces to polish, as well as to clean and smoothen.

BACKGROUND OF THE ART

There are on the market numerous compositions and articles of manufacture for use in polishing surfaces. Some of these function by depositing a lacquer, oil, wax or polish on the surface. Others serve to abrade the surface and smoothen as well as polish it.

Specific products include foamed polymeric materials which incorporate an abrasive substance. See., e.g., Nishimura, U.S. Pat. No. 4,034,769, Jury et al., U.S. Pat. No. 3,918,220, Spitzer et al., U.S. Pat. No. 3,912,667, and Wilson, U.S. Pat. Nos. 2,609,347 and 2,664,366.

OBJECTS OF THE INVENTION

It is an object of this invention to provide compositions capable of polishing a wide variety of surfaces.

It is another object of this invention to provide compositions which impart a luster to a given surface without the necessity for depositing a foreign substance such as lacquer, oil, wax, or polish thereon.

It is another object of this invention to provide a composition which is essentially suitable for smoothening the surface of human fingernails, while also enhancing the gloss on unlacquered fingernails or restoring the gloss on lacquered fingernails.

It is another object of this invention to provide a composition which is capable of polishing teeth.

It is still another object of this invention to provide articles of manufacture which incorporate the foregoing compositions and are adapted for polishing surfaces.

It is a further object of this invention to provide improved methods of polishing surfaces, ranging from hard metallic surfaces to relatively softer surfaces, as well as improved methods for the manufacture of polishing compositions.

SUMMARY OF THE INVENTION

The compositions according to this invention, briefly described, comprise (a) a foamed polymer; and (b) a particulate abrasive compound having a particle size and a valley abrasion number the product of which falls within a predetermined range sufficient to provide good polishing when a surface is buffed with the composition.

An abrasive compound having a multiplication product within the range between 300 and 1650 is preferred for use in this invention. Such a compound provides polishing results ranging from good to excellent, as shown in the examples.

The foam matrix is characterized by being soft, fine celled, very hydrophilic (capable of absorbing and retaining water) and compressible. The foamed composition may be used in the form of a sheet or block cut to any desired shape, or it may be attached in any manner to an implement which can be held in one hand and rubbed across the surface being buffed. The foamed composition or articles made from the foamed composition may be used, when dry, to buff any surface normally capable of being polished. Such surfaces include hard metal surfaces such as found on hardware, jewelry, cookware, small household appliances, and the like.

The compositions may also be used to smoothen as well as polish human fingernails, and special mention is made of this particular use.

Another aspect of the invention includes foamed dental compositions which are capable, when wet, of polishing and cleaning human teeth.

The specified multiplication product of the abrasive compound is, it has now been found, a reliable index of polishing effectiveness. As shown in the examples, if this product is too low or too high, good polishing results are not achieved. This invention thus enables those skilled in the art to select an abrasive compound having a suitable particle size and a suitable valley abrasion such that satisfactory polishing will result when the compound has been incorporated into the specified foamed polymer and the composition is used to buff a surface.

DETAILED DESCRIPTION OF THE INVENTION

The polymer and the abrasive may be present in the compositions in a wide range of proportions. In general, compositions according to this invention comprise from about 5 to about 95 parts by weight of the foamed polymer and from about 95 to 5 parts by weight of the abrasive compound, and more usually, from about 30 to about 70 parts by weight of the polymer and from about 70 to about 30 parts by weight of the abrasive compound.

The abrasive compound is preferably a finely divided, substantially water insoluble solid which is capable of providing at least some mechanical abrasion when rubbed on a surface. The abrasive may be selected from any of the known materials conventionally employed for such a purpose, providing the product of the particle size and valley abrasion number is in accordance with this invention. Examples of suitable materials include diatomite (diatomaceous earth), calcium carbonate, dicalcium phosphate, pumice, silica, calcium pyrophosphate, rouge and kaolin.

The polymer is any hydrophilic polymeric material capable of foaming upon admixture with water. Preferably, a polyurethane, or a polyvinyl alcohol-formaldehyde reaction product (also referred to as a "polyvinyl formal"), is employed.

In addition to the foamed polymer and the abrasive compound, the compositions of this invention can also contain other ingredients without adversely affecting the benefits of this invention. Such ingredients include curing catalysts, coloring agents, fragrances, emollients, nail or skin conditioners, antioxidants, and the like. In general, these are added in minor amounts, typically from about 0.05 to about 5 parts by weight, based on the total weight of the dry composition. These may be added before, during or after foaming, but preferably after the composition has foamed and cured. It coloring agents are used, it is preferred to add them when the polymer, abrasive and water are being admixed and before foaming and curing have been completed.

It is preferred to include a substance for adjusting the pH, e.g., phosphoric acid or sodium hydroxide depending on the initial pH of the mix. The pH adjustor is preferably present in an amount sufficient to provide a stabilized neutral, or nearly neutral, pH of from about 6 to about 8, preferably about 7.

The preferred urethane polymers may be prepared using methods of preparation known to those skilled in the art. Illustratively, the preferred hydrophilic polyurethane is made by polymerizing an alkylene oxide, e.g., ethylene oxide, in the presence of a polyfunctional hydroxyl-containing compound, e.g., glycerol, trimethylolpropane, trimethylolethane, pentaerythritol, or the like, to yield a polyoxyalkylene polyol. The polyoxyalkylene polyol is thereafter reached with a polyisocyanate, preferably using a stoichiometric excess of the polyisocyanate. Examples of suitable polyisocyanates include tolylene diisocyanate, triphenylmethane-4,4,',4'',-triisocyanate, benzene-1,3,5-triisocyanate, hexamethylene diisocyanate, xylene diisocyanate and chlorophenylene diisocyanate, as well as mixtures of any of the foregoing.

The reaction may be carried out under nitrogen at atmospheric pressure, using a temperature in the range of 0° and 120° C., for a period of about 20 hours although particular reaction times will vary depending on factors such as the reaction temperature and amount of mixing conducted during the reaction. There results a hydrophilic urethane polymer which is capable, when admixed with water, of undergoing foaming and room temperature curing.

The preferred polyvinyl alcohol-formaldehyde reaction product (polyvinyl formal) may be prepared by following procedures described in U.S. Pat. Nos. 2,609,347 and 2,664,366, the disclosures of which are incorporated herein by reference to save detail.

The foamed abrasive compositions of this invention, comprising the polymers of choice, are prepared by mixing the ingredients together under ambient conditions and permitting the mixture to foam and to harden. Preferably, an aqueous slurry of the abrasive compound is prepared separately and then admixed with the polymer. In those compositions in which the polymer is a polyurethane, it is preferred to use from about 10 to about 200 parts, more usually from about 50 to 160 parts, of water for each 100 parts of the polymer, on a weight basis.

Heat may be applied during mixing. In general, this serves to increase the cell size and decrease the density of the foam. Care should be taken not to exceed the decomposition temperature of the polymer or the temperature at which thermal damage of the polymer results—generally about 200° F.

After foaming has been completed, the foamed composition may be permitted to dry at room temperature, or heat may be applied to drive off the water and thus facilitate drying.

The foamed composition may be manufactured into handholdable articles of any desired shape or size.

DETAILED DESCRIPTION OF THE DRAWINGS

Figure 1:
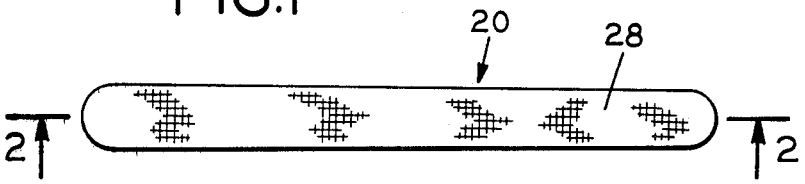
FIG. 1 is a top plan view of an article according to the invention which is suitable for polishing and smoothening human fingernails.
Figure 2:
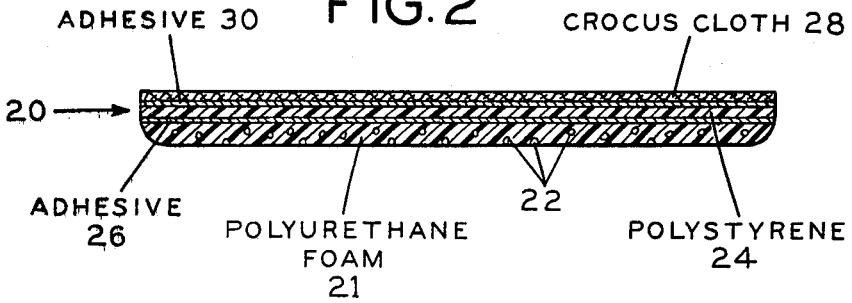
FIG. 2 is a traversal section taken along lines 2—2 of the article of FIG. 1.

With reference to FIGS. 1 and 2, depicting polishing article 20, polyurethane foam layer 21 contains finely divided abrasive particles 22, distributed throughout, with some of the particles being exposed on the surface of the foam layer. Foam layer 21 is affixed to plastic, e.g., polystyrene, base 24 by adhesive layer 26. Layer 26 may be comprised of any adhesive. Crocus cloth layer 28, comprised of finely divided iron oxide, is affixed to polystyrene base 24 by adhesive layer 30. The adhesive of layer 30 may be the same as or different than the adhesive of layer 26.

Figure 3:
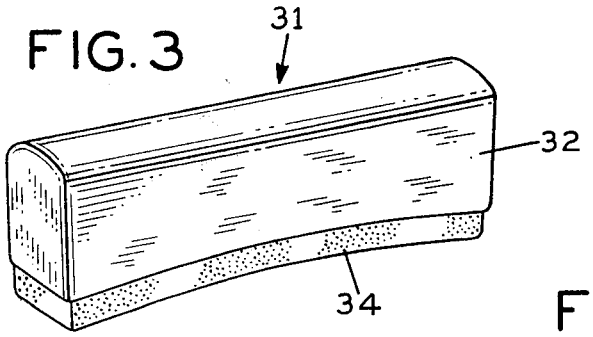
FIG. 3 is a perspective showing of an assembly in which a polishing element comprising a foam layer in which abrasive particles have been incorporated has been attached. In this embodiment, the polishing element has an external concave configuration.
Figure 4:
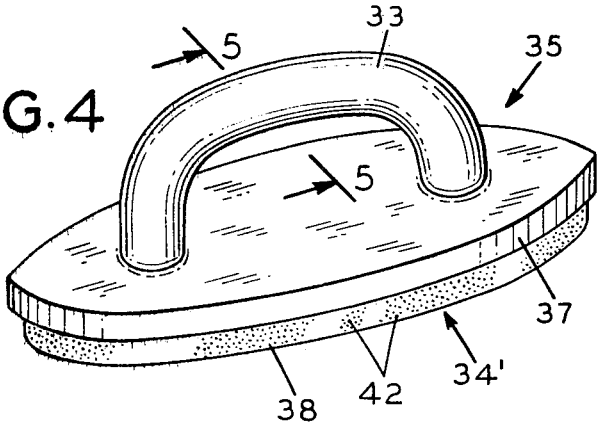
FIG. 4 is a perspective showing of another assembly according to the invention, having a polishing element and a handle.

The polishing article can also have the constructions shown in FIGS. 3 and 4, respectively. With reference to FIG. 3, article 31 comprises holding implement 32, to which polishing element 34 has been attached. Holding implement 32 may be made of molded plastic, which may be hollow or solid. With reference to FIG. 4, polishing article 35 comprises holding implement 33, which is mounted on base member 37. Polishing element 34', which is attached to base member 37, includes foam layer 38, in which abrasive particles 42 are incorporated.

Figure 5:
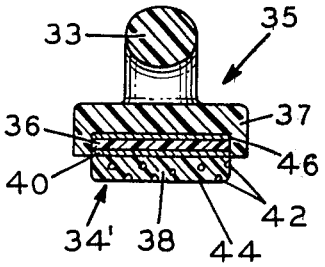
FIG. 5 is a traversal section taken along lines 5—5 of FIG. 4.

FIG. 5 shows the article of FIG. 4 taken in section through 5—5. With reference to FIG. 5, polishing element 34' consists of foam layer 38, which is affixed by adhesive layer 40 to plastic (e.g., polystyrene) base 36. Base 36 is, in turn, affixed by abrasive layer 46 to base member 37. Adhesive particles 42 are distributed throughout foam layer 38, and some are exposed on lower surface 44 of layer 38.

In operation, the foregoing articles are held in one hand and rubbed across the surface of the fingernails on the other hand. Crocus cloth layer 28 of polishing article 20, in particular, in FIGS. 1 and 2, may be used to round off the tips of the fingernails.

Figure 6:
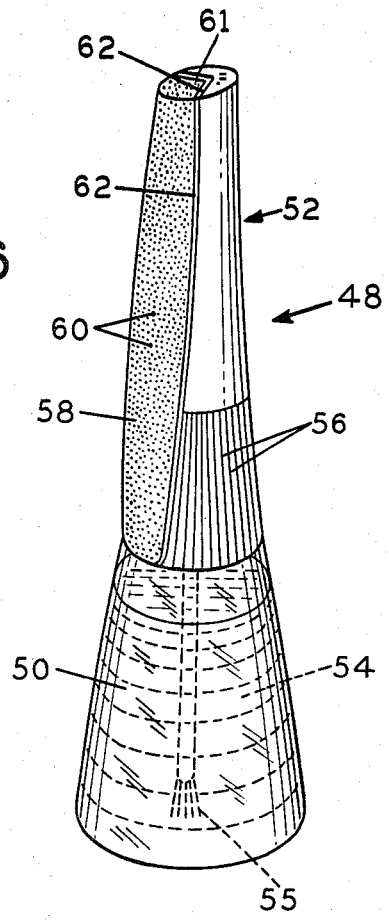
FIG. 6 is a side elevation of a nail polish bottle in which a polishing element has been incorporated.
Figure 7:
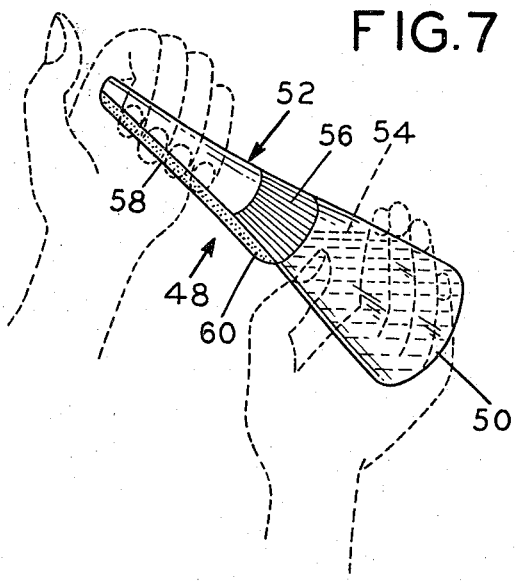
FIG. 7 is another view of the article of FIG. 6, shown in use.

The polishing compositions of the invention can also be fashioned into other useful articles, such as those shown in FIGS. 6 and 7. With reference to FIG. 6, nail polish bottle 48 comprises reservoir 50 and removable top 52. Reservoir 50 contains nail polish 54. Removable top 52 includes conventional brush 55 and ridges 56. Ridges 56 may be gripped by the fingers of one hand to facilitate twisting and removing. Foam layer 58, containing abrasive particles 60, is affixed by adhesive layer 61, to V-shaped groove 62.

In operation, the bottle is held in one hand and removable top 52 is gripped, optionally at ridges 56, by the other hand, twisted and removed. Nail polish is then applied to the fingernails, permitted to dry, and later buffed with polishing element 58 to enhance gloss. Polishing element 58 may also be used on polished nails after an extended period of wear, in order to restore the original gloss.

Figure 8:
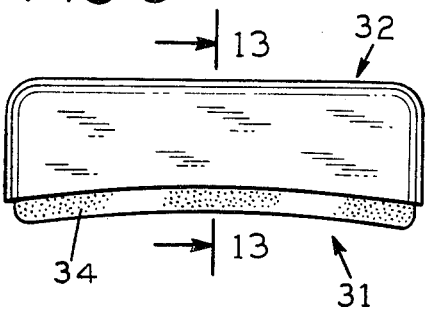
FIG. 8 is a side elevation of the assembly shown in FIG. 3.
Figure 9:
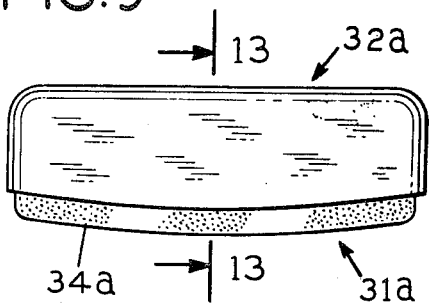
FIG. 9 is a view similar to FIG. 8, showing an external convex configuration for the polishing element.
Figure 10:
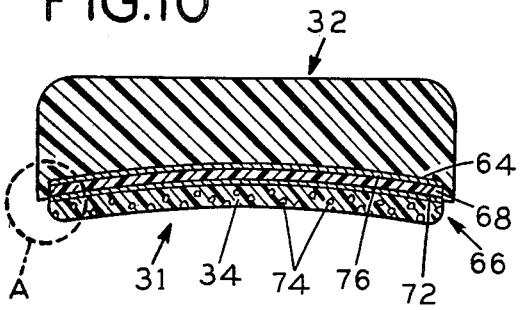
FIG. 10 is a side cross-sectional view of the article of FIG. 8.
Figure 13:
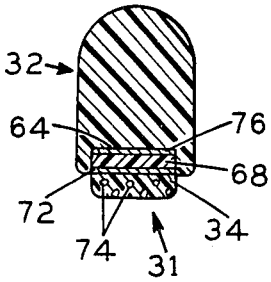
FIG. 13 is a traversal section taken along lines 13—13 of FIGS. 8 and 9.
Figure 12:
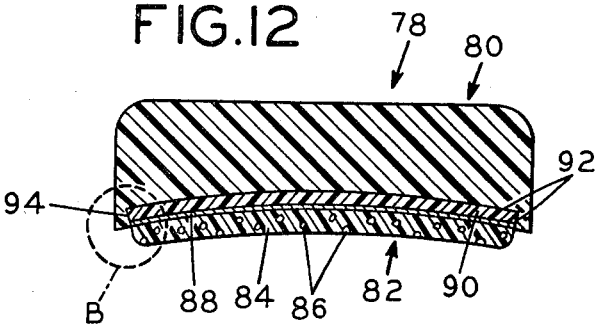
FIG. 12 is a view similar to FIG. 11, showing the polishing element after re-insertion.
Figure 14:
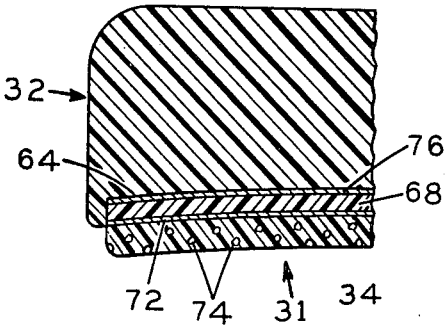
FIG. 14 is an exploded view of parts (A) shown in FIG. 10.
Figure 15:
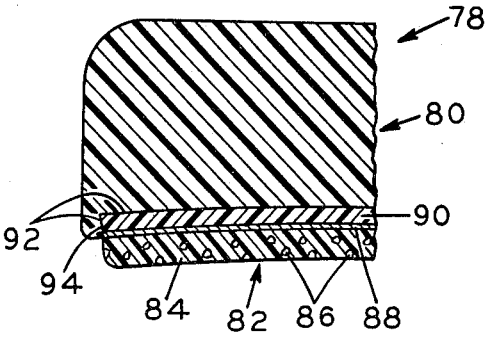
FIG. 15 is an exploded view of parts (B) shown in FIG. 12.
Figure 16:
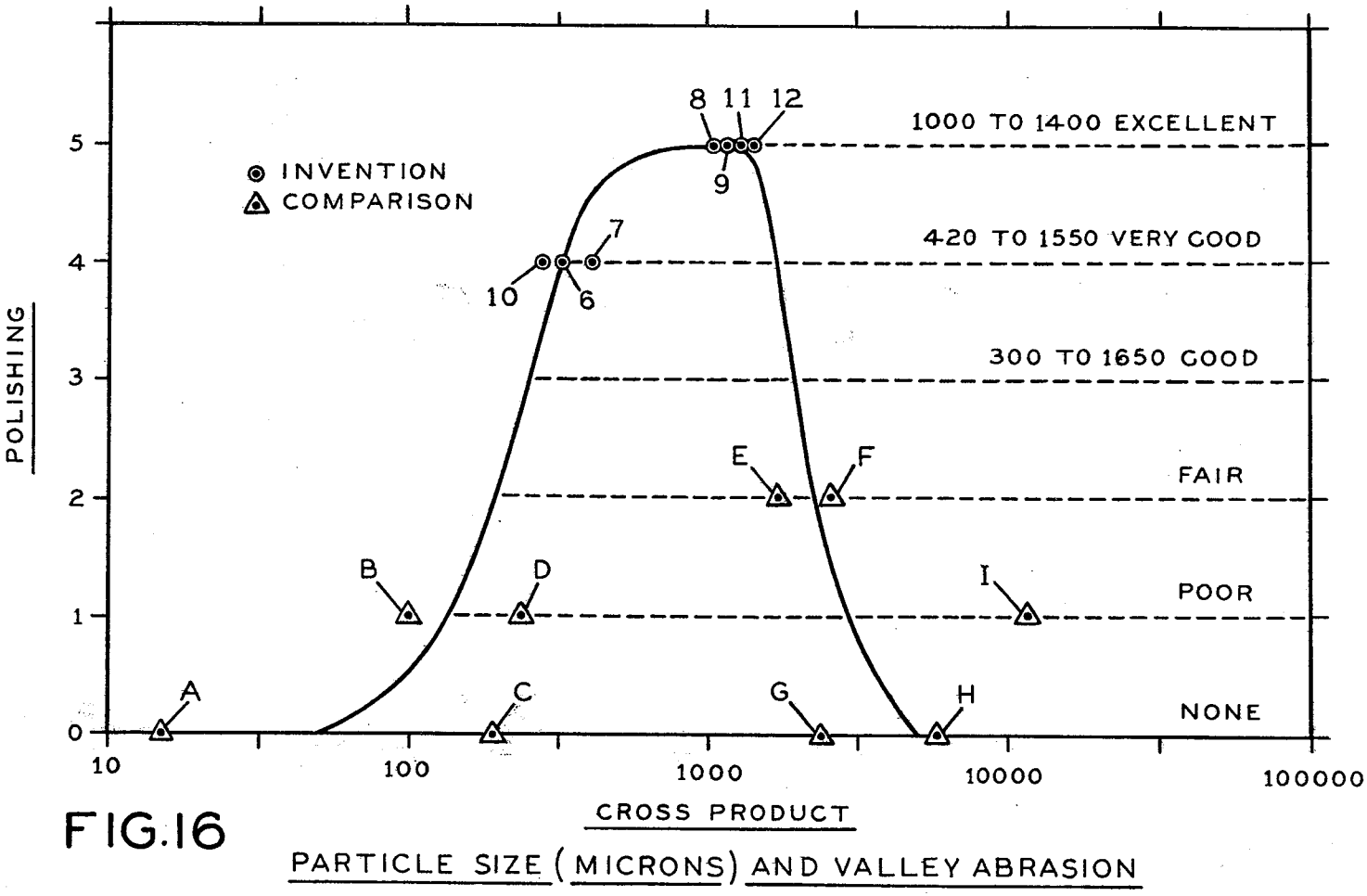
FIG. 16 is a graphical presentation of the data in the Table of Polishing Compounds and Properties. The polishing rating, ranging from none to excellent, has been plotted on the vertical axis. The cross product of the particle size number in microns and the valley abrasion number has been plotted on the horizontal axis.

The article of FIG. 3 is depicted also in FIG. 8, and in further detail in FIGS. 10, 13 and 14. With reference to FIG. 10, polishing article 31, comprises holding implement 32, which contains cavity 64. Polishing element 34 is inserted in cavity 64 and affixed by adhesive layer 76. Polishing element 34 consists of foam layer 66, in which abrasive particles 74 are distributed, and which is affixed by adhesive layer 72 to plastic base 68. These details are also shown in FIGS. 13 and 14.

Figure 11:
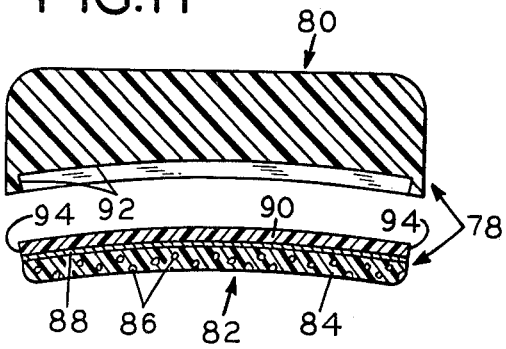
FIG. 11 is a view similar to FIG. 10, showing a detachable polishing element which has been removed.

As an alternate embodiment, a polishing article as in FIG. 8 can be constructed as shown in FIG. 11 to contain a detachable polishing element which can be removed after use and replaced by a fresh element. With reference to FIG. 11, polishing article 78 comprises holding implement 80 and detachable polishing element 82. Polishing element 82 consists of foam layer 84, containing abrasive particles 86, which is affixed by adhesive layer 88 to plastic base 90. Holding implement 80 contains cavity 92, having canted sides all around, into which polishing element 82 is inserted. Plastic base 90 has canted sides 94, which correspond to the canted sides of cavity 92. Polishing element 82 is slightly larger than cavity 92, to ensure a snug fit. In practice, element 82, which is flexible, is bent slightly and inserted into cavity 92, in which it extends to fit snugly against the canted sides of cavity 92. No adhesive is required.

DESCRIPTION OF THE PREFERRED EMBODIMENTS

The invention is further illustrated in the following examples. These are not to be understood as limiting the invention to the particular embodiments shown.

In the examples, the particle size number and valley abrasion number are measured using the following procedures:

PARTICLE SIZE MEASUREMENT

This method will provide a visual means of particle size analysis.

Apparatus

1. Glass microscope slides
2. Eye droppers (straight)
3. Test tubes with caps
4. Microscope (AO series 20)
5. Bausch & Lomb Omnicon Alpha Image Analyzer, with microscope adapter and calibration graticule.

Procedure

A. Sample Preparation:

1. Obtain representative samples by a valid technique that is applicable to the material being analyzed.
2. Prepare microscope slides by an appropriate method to obtain a uniform dispersion. Two methods are:
   a. Dry dispersion
      1. Drop a small amount of material down a long 2" dia. tube onto the microscope slide using a vibrating spatula.
   b. Wet dispersion
      1. Disperse sample in an appropriate dispersion medium such as methanol (trial and error may be needed depending on the material being tested). Use about $2\times10^{-3}$ g/ml. and shake thoroughly.
      2. While sample is thoroughly dispersed withdraw a small portion from center of tube using an eye dropper.
      3. Deposit one drop on the center of the slide and allow the dispersant to evaporate.
      4. Check to be sure you have good distribution and sufficient sample for analysis of three areas on the slide.

B. Instrument Calibration:

1. Connect the microscope to the Omnicon using the adapter tube.
2. Set up the microscope according to its operating manual.
3. Turn on the power for the Omnicon, turn the Scanner Sensitivity switch fully clockwise past the click stop to "Auto" (operate according to procedure recommended by Bausch and Lomb).
4. Using the calibrated graticule, determine the "K factor" for the Omnicon according to its operating manual. (This procedure consists of comparing the area of a circle on the graticule, as read by the instrument, to the area for the same circle calculated from a known diameter).
5. Record the K factor for later use.

C. Particle Size Analysis:

1. Mount the sample slide on the microscope stage (microscope light is normally set for 9.5 V).
2. Measure particle size distribution on the oversize count mode, starting at an appropriate lower limit, and proceeding to the appropriate upper limit by suitable intervals. The video picture shows the particles being analyzed (in the bounded area) and the total number of particles larger than the diameter that is set. The total number of particles can be read by setting the oversize count to zero, or by switching to the total area mode.
3. At least three areas per slide are measured for distribution and each measurement is repeated three times.

Results

The percent of particles in a given size interval will be calculated from the measurements and plotted on log probability graph paper as "percent larger than stated size" vs "particle size (microns)". Normal expected distributions plot as straight lines.

Calculations

% Larger:

$$\frac{\text{number of particles greater than set size}}{\text{total number of particles}} \times 100 = \%$$

number of particles greater than is a direct instrument readout.

% Smaller than size:

$$\frac{\text{total number of particles minus number of particles greater than the set size}}{\text{total number of particles}} \times 100 = \%$$

Actual diameter is the set diameter multiplied by the "K factor" which should be calculated prior to sample analysis.

Error

The smallest particle sizes (less than 10 microns) can be expected to yield a standard deviation of ±10% with a minimum of measurements. A larger sample will improve this considerably. The higher particle size intervals show standard deviations of ±2%.

VALLEY ABRASION MEASUREMENT

According to Procedure 65 of The Institute of Paper Chemistry, using Valley Abrasion Test Apparatus made by Voith-Allis, Inc.

A. Sample Preparation

Weigh out 100 grams of the particulate abrasive test material and measure 3.2 liters of distilled water. A wetting agent, such as Calgon-T, Pluronic-62, or equivalent, is added in an amount of 0.1% by weight to a small portion of the water and stirred into the abrasion material to make a thoroughly wet paste. When this is accomplished, gradually add the remaining water, stirring the slurry with a Lightnin' Mixer or similar mixing device. Check the pH of the slurry and adjust to approximately 7.0. Charge the slurry to the Valley Abrasion Tester and circulate the slurry with a pump. Check the pH once more before starting the test.

B. Operation (1) Conditioning the Wire in the Tester

A new wire is conditioned before it is used by inserting a wire in the Tester and running the sliding block across the wire for two hours (10,000 cycles) with distilled water only at the interface; 3.2 liters of distilled water are used. All other conditions are the same as those used in making a test. The conditioned wire is thoroughly washed, oven dried and its weight determined to the nearest milligram.

(2) Running a Test

A conditioned wire is placed in the frame of the Tester and the Tester is assembled. The abrasive slurry is poured onto the perforated sliding block of the Tester and the pump and block motion of the Tester is started. After 6,000 cycles (about 70 minutes) the Tester is stopped and the wire is removed and washed. The wire is then oven dried and weighed and the loss in weight is calculated. If the loss is under 100 milligrams, the same wire may be used for three successive tests. If the loss in weight is greater than 100 milligrams, the wire should be used only once. It is recommended that a wire be used only once when testing talcs in particular.

When disassembling the Tester after running a test, all parts are thoroughly washed. The test sample is dumped and the equipment is flushed with tap water until the effluent becomes clear.

C. Constant Conditions and Specifications of Test Equipment

1. Pump: Model 500 Randolph, fitted with gum rubber tubing.
2. Motor arrangement: Bellows continuous cycling, adjustable stroke, foot mounted, Model B5313-2018 air motor; Bellows muffler No. A279; lubricator, filter, regulator and gauge assembly.
3. Pumping rate: 850–1050 ml./min.
4. Block composition: Micarta
5. Weight of block and brass weight: 17.5–17.8 lb. (minus drive arm)
6. Block wear area: 3-1/16×3-11/16 inches
7. Block type: drilled, "Valley" design
8. Stroke length: 4 inches
9. Block travel rate: 85 cycles/min.
10. Wire is 70×48-mesh plain weave, bronze cloth. Wire size is 3-7/16×8-13/16 inches with 70 wires/inch in the long direction.

Abrasiveness is reported as milligrams lost in wire weight. Triplicate determinations are recommended. Checks to agree with ±10%. In general, low abrasive materials will give abrasiveness values from 2 to 20 milligrams, moderately abrasive materials from 20 to 40 milligrams and very abrasive materials from 50 upwards to 200 milligrams or more.

EXAMPLE 1

According to this invention, a polishing article having the following composition is prepared:

| Ingredients | Amount, parts by weight |
|---|---|
| Foamable polyurethane polymer, W.R. Brace's Hypol (a viscous liquid) | 50 |
| Diatomite, Johns Manville's Celite, particle size number = 5.5 micrometers (microns), valley abrasion number = 207 | 30 |
| Water | 50 |

In preparing the composition, the following procedure is employed:

The diatomite is added to the water, with stirring, and a uniform slurry is formed. The polyurethane is weighed separately, then added with stirring to the aqueous slurry of the diatomite. To facilitate pouring, the liquid polyurethane may be heated to about 160° F. prior to being added to the diatomite slurry. If the polyurethane is to be heated, the diatomite slurry should be separately cooled to a temperature in the range between 35° and 45° F. to compensate. After the polyurethane has been added to the diatomite slurry mixing is continued for several minutes. The mixture is then allowed to expand into a foam, which should take only a few minutes.

The resulting foam product is then allowed to dry and undergo shrinkage for a minimum period of about 12 hours, normally 2–3 days. In the alternative, the foam product can be dried by applying heat, or it may be cut and shaped while still wet and thereafter permitted to dry.

The finished article is especially useful in unlacquered fingernails to smoothen the nail surfce and to impart a shine. The same article can also be used on fingernails to which lacquer has been previously applied in order to restore gloss which has worn off.

EXAMPLE 2

In accordance with the invention, the procedure described in Example 1 is repeated, except that the following composition is employed:

| Ingredients | Amount, parts by weight |
|---|---|
| Foamable polyurethane polymer, W.R. Grace's Hypol | 20 |
| Calcium carbonate, particle size number = 11 microns, valley abrasion number = 38 | 30 |
| Water | 50 |

The resulting foam product can be used to polish a variety of surfaces including human fingernails to obtain substantially the same results as in Example 1.

EXAMPLE 3

Using the procedure of Example 1, a foam article according to the invention having the following composition is prepared:

| Ingredients | Amount, parts by weight |
|---|---|
| Foamable polyurethane polymer, W.R. Grace's Hypol | 20 |
| Calcium carbonate, particle size number = 11 micrometers (microns), valley abrasion number = 38 | 30 |
| Petroleum jelly* | 1.5 |
| Isopropyl palmitate* | 1.35 |
| Alkyl branched fatty acid ester* | 0.15 |
| Water | 47 |

*stirred into polyurethane prior to admixing with calcium carbonate slurry

The foam article which results can be used to obtain the same results as in Example 1.

EXAMPLE 4

Repeating the procedure of Example 1, a foam product having the following composition according to the invention is prepared:

| Ingredients | Amount, parts by weight |
|---|---|
| Foamable polyurethane polymer, W.R. Grace's Hypol | 40 |
| Diatomite, Johns Manville's Celite (as in Example 1) | 30 |
| Water | 30 |

Substantially the same results as in Example 1 are obtained.

EXAMPLE 5

Another foam product according to the invention is prepared with the following composition, using the procedure described in Example 1.

| Ingredients | Amount, parts by weight |
|---|---|
| Foamable polyurethane polymer, W.R. Grace's Hypol | 38.5 |
| Diatomite, Johns Manville's Celite (as in Example 1) | 38.5 |
| Water | 23 |

EXAMPLES 6–12

A dry foam product (which may include 1–2% by weight of water of hydration), consisting of 50 parts by weight of polyurethane foam (W. R. Grace's Hypol) and 50 parts by weight of abrasive compound (shown in the Table), is prepared and evaluated for polishing by rubbing across the fingernails of one hand. The physical properties of the abrasive and the polishing properties of the dry foam product are summarized in the Table.

TABLE

| | | Polishing Compounds and Properties | | | |
|---|---|---|---|---|---|
| EXAMPLE | COMPOUND | PARTICLE SIZE, MICRONS | VALLEY ABRASION NUMBER | CROSS-PRODUCT | POLISHING |
| 6 | Diatomite, Johns-Manville's Snow Floss | 6.7 | 72 | 482 | very good |
| 7 | Diatomite, Johns-Manville's Celite 315 | 5.4 | 103 | 586 | very good |
| 8 | Diatomite, Johns-Manville's Super Floss | 5.5 | 207 | 1139 | excellent |
| 9 | Diatomite, Johns-Manville's Celite White Mist | 8.0 | 157 | 1256 | excellent |
| 10 | Calcium carbonate | 11.0 | 38 | 418 | very good |
| 11 | Rouge (jeweler's) | 6.2 | 196 | 1215 | excellent |
| 12 | Microgrit (extracted from Gesswein's Luster Bar, a combination of stearic acid, wax and microgrit) | 1.5 | 752 | 1128 | excellent |
| A* | Dicalcium phosphate | 7.3 | 2 | 15 | non-polishing |
| B* | Kaolin | 1.0 | 100 | 100 | poor |
| C* | Calcium pyrophosphate | 7.3 | 26 | 190 | non-polishing |
| D* | Calcium carbonate | 6.2 | 39 | 242 | poor |
| E* | Diatomite, Johns-Manville's Celite 400 | 7.5 | 166 | 1245 | fair |

TABLE-continued

| EXAMPLE | COMPOUND | Polishing Compounds and Properties PARTICLE SIZE, MICRONS | VALLEY ABRASION NUMBER | CROSS-PRODUCT | POLISHING |
|---|---|---|---|---|---|
| F* | Diatomite, Johns-Manville's Celite 292 | 7.5 | 234 | 1755 | fair |
| G* | Diatomite | 8.8 | 5.0 | 4488 | non-polishing |
| H* | Silica | 9.0 | 789 | 7101 | non-polishing |
| I* | Diatomite, Johns-Manville's Celite 503 | 23 | 690 | 15870 | poor |

*comparison experiment

With reference to FIG. 4, the multiplication product of the particle size number (in microns) and valley abrasion number for each of the abrasive compounds as noted in the Table is plotted on the horizontal axis. The polishing rating corresponding to each abrasive compound is plotted on the vertical axis. A bell-shaped curve is obtained in which the most favored polishing results (good to excellent) are seen to fall within the maximum part of the curve, corresponding to a cross product within the range between 300 and 1650. Abrasive materials having a cross product outside this range (indicated by letters) provide inferior polishing.

As can be seen, these results provide a convenient index by which to choose abrasive materials having a particle size number and valley abrasion number sufficient to provide the most effective polishing in accordance with the invention.

EXAMPLE 13

This example illustrates the preparation of a foam product in which the polymer is a polyvinyl alcohol-formaldehyde reaction product. The composition is as follows:

| | | |
|---|---|---|
| Part A | Polyvinyl alcohol | 20 grams |
| | water | 150 grams |
| Part B | Sulfuric acid | 55 grams |
| | water | 50 grams |
| Part C | Tween 20 | 0.5 gram |
| | Super Floss Diatomaceous earth | 40 grams |
| | Glycerin | 2.5 grams |
| Part D | Formaldehyde | 27 grams |

The above composition is prepared as follows:

The polyvinyl alcohol is first dissolved in water to form a viscous solution (Part A). Heat or live steam may be used to aid in formation. The temperature should not be allowed to exceed 90° C.

After Part A has been formed, the temperature is reduced to 60° C. and the sulfuric acid solution (Part B) is added. It is preferred to dilute the acid, 3 parts of acid per 1 part of water, in order to avoid charring or overheating. Next, Part C, containing the abrasive and surfactant, is added. The mixture is mixed until smooth. Finally, the formaldehyde (Part D) is added and mixing is continued. At this time, air is frothed into the mixture by beating with a steel wire wisk, open paddle or other suitable mechanical means. After airation to about twice the original volume, the product is poured into a plastic bag and allowed to cure at 60° C. for a period of approximately 12 hours. The cured foam is removed from the bag and washed until free of excess sulfuric acid and then it is dried.

The dried product may be fashioned into an article suitable for brushing teeth, comprising, for example, a handle, a base and the foam composition.

Other modifications and variations of this invention are possible in view of the above disclosure. It is to be understood that changes may be made in the specific embodiments described without departing from the scope and spirit of the invention, and without detriment to its chief benefits.

We claim:

1. A polishing article, which comprises a holding implement and a polishing composition comprising a foamed polymer, and having distributed throughout a particulate abrasive compound, said compound having a particle size and a valley abrasion number the product of which yields a number which falls in the range between 300 and 1650.

2. The article of claim 1, in which the foamed polymer is a polyurethane or polyvinyl alcohol-formaldehyde reaction product.

3. The article of claim 1, in which the abrasive material is selected from the group consisting of diatomite, calcium carbonate, rouge, silica, kaolin, dicalcium phosphate and calcium pyrophosphate.

4. An article for polishing and smoothening fingernails, which comprises a base and a composition comprising a foamed polyurethane and having distributed throughout a particulate abrasive compound having a particle size and a valley abrasion number the product of which is in the range between 300 and 1650.

5. An article for polishing and cleaning teeth, which comprises a handle, a base and a composition comprising a foamed polyvinyl alcohol-formaldehyde reaction product and having distributed throughout a particulate abrasive compound having the particle size and a valley abrasion number the product of which is in the range between 300 and 1650.

6. A nail polish bottle comprising a reservoir for holding nail polish and a removable top having included on the surface a polishing composition comprising a foamed polymer and having distributed throughout a particulate abrasive having a particle size and a valley abrasion number the product of which is in the range between 300 and 1650.

7. In a method of polishing a surface with a composition comprising a foamed polymer and an abrasive material, the improvement comprising using as said abrasive a compound having a particle size (in micrometers) and a valley abrasion number the product of which falls is in the range between 300 and 1650.

8. The method of claim 7, in which the foamed polymer is a polyurethane or a polyvinyl alcohol-formaldehyde reaction product.

9. The method of claim 7, in which the abrasive is selected from the group consisting of diatomite, calcium carbonate, rouge, silica, kaolin, dicalcium phosphate and calcium pyrophosphate.

10. A method of polishing fingernails comprising buffing said fingernails with a composition comprising a foamed polymer and having distributed throughout a particulate abrasive compound which has a particle size and a valley abrasion number the product of which is in the range between 300 and 1650.

11. A method of polishing teeth comprising buffing said teeth with a composition comprising a foamed polymer and having distributed throughout a particulate abrasive compound which has a particle size (in micrometers) and a valley abrasion number the product of which is in the range between 300 and 1650.

12. In a method of manufacturing a polishing article which includes a composition comprising a foamed polymer and an abrasive material, the improvement comprising using as said abrasive material a compound having a particle size and a valley abrasion number the product of which is in the range between 300 and 1650.

13. The method of claim 12, in which the foamed polymer is a polyurethane or a polyvinyl alcohol-formaldehyde reaction product.

14. The method of claim 12, in which the abrasive compound is selected from the group consisting of diatomite, calcium carbonate, rouge, silica, kaolin, dicalcium phosphate and calcium pyrophosphate.

15. The method of claim 12, comprising forming an article suitable for polishing and smoothening fingernails which comprises a base and said composition.

16. The method of claim 15, in which the foamed polymer is a polyurethane.

17. The method of claim 12, which comprises forming an article suitable for brushing teeth which comprises a handle, a base and said composition.

18. The method of claim 17, in which the foamed polymer is a polyvinyl alcohol-formaldehyde reaction product.

* * * * *